US008649547B2

(12) United States Patent
Hsu Huang et al.

(10) Patent No.: US 8,649,547 B2
(45) Date of Patent: Feb. 11, 2014

(54) MOUNTABLE MULTI-DIRECTIONAL AUDIO DEVICE

(75) Inventors: Yueh-Hua Hsu Huang, New Taipei (TW); Wen-Chuan Hsu, New Taipei (TW); Chun-Ti Chen, New Taipei (TW)

(73) Assignee: Jazz Hipster Corporation, New Taipei (TW)

( * ) Notice: Subject to any disclaimer, the term of this patent is extended or adjusted under 35 U.S.C. 154(b) by 0 days.

(21) Appl. No.: 13/326,630

(22) Filed: Dec. 15, 2011

(65) Prior Publication Data

US 2013/0156250 A1 Jun. 20, 2013

(51) Int. Cl.

| | |
|---|---|
| ***H04R 1/00*** | (2006.01) |
| ***H04R 25/00*** | (2006.01) |
| ***H04R 1/02*** | (2006.01) |

(52) U.S. Cl.

USPC ..... 381/385; 381/373; 381/374; 381/379; 381/386

(58) Field of Classification Search

USPC ..... 381/373, 374, 379, 385, 386, 370, 371, 381/381–383, 309, 338, 160; 181/128, 129

See application file for complete search history.

(56) References Cited

U.S. PATENT DOCUMENTS

| | | | | |
|---|---|---|---|---|
| 2,141,423 | A * | 12/1938 | Tolerton | 381/386 |
| 4,058,688 | A * | 11/1977 | Nishimura et al. | 381/372 |
| 6,412,593 | B1 * | 7/2002 | Jones | 181/129 |
| 6,993,143 | B2 * | 1/2006 | Harris et al. | 381/379 |
| 7,155,025 | B1 * | 12/2006 | Weffer | 381/370 |
| 7,426,282 | B1 * | 9/2008 | Poss | 381/370 |
| 8,213,632 | B2 * | 7/2012 | Yamagishi et al. | 381/87 |
| 8,371,417 | B2 * | 2/2013 | Miyazawa | 181/129 |
| 8,538,059 | B2 * | 9/2013 | Yamagishi et al. | 381/371 |
| 2006/0104471 | A1 * | 5/2006 | Tsunoda et al. | 381/374 |
| 2008/0075314 | A1 * | 3/2008 | Chang | 381/371 |
| 2008/0122736 | A1 * | 5/2008 | Ronzani et al. | 345/8 |
| 2008/0170738 | A1 * | 7/2008 | Hope et al. | 381/371 |
| 2009/0147982 | A1 * | 6/2009 | Ashida et al. | 381/384 |
| 2009/0285435 | A1 * | 11/2009 | Nelson et al. | 381/378 |
| 2010/0067714 | A1 * | 3/2010 | Cheng | 381/74 |
| 2010/0177907 | A1 * | 7/2010 | Morisawa | 381/74 |
| 2012/0093351 | A1 * | 4/2012 | Amsel | 381/378 |
| 2012/0275615 | A1 * | 11/2012 | Kelly et al. | 381/74 |
| 2013/0003984 | A1 * | 1/2013 | Belafonte et al. | 381/74 |

* cited by examiner

*Primary Examiner* — Duc Nguyen
*Assistant Examiner* — Sean H Nguyen
(74) *Attorney, Agent, or Firm* — Ming Chow; Sinorica, LLC

(57) ABSTRACT

A mountable multi-directional audio device comprises at least one broadcasting device, which has a sounding portion outwardly; and at least one connecting member, the any end of the connecting member is connected with the broadcasting device.

18 Claims, 22 Drawing Sheets

MOUNTABLE MULTI-DIRECTIONAL AUDIO DEVICE

BACKGROUND OF THE INVENTION

1. Field of the Invention

The present invention relates to a mountable multi-directional audio device, more particularly, to an audio device that is worn on the body of a user.

2. Description of the Prior Art

Nowadays, earphones project sound to its surroundings via internal speakers. There are two types of earphones, one worn in the ears (ear wearing), and the other worn over the head (head wearing). The ear wearing earphones are worn with direct contact to the ear and is very close to the tympanic membrane, thus long-term usage of such earphones may cause damage to soft tissue in the ear.

Both of the ear wearing earphones and the head wearing earphones have their own pros and cons. However, because both of the earphones mentioned above project sounddirectly to a user's ears, when a user uses such earphones, the user may not be able to hear other sounds from the environment, such as alert sounds. Therefore, it can sometimes be very dangerous to the user.

In addition, speakers cannot be worn on a user due to their volumes and weights, so it would not be practical to use such speakers to slove the saftey problems caused by earphones.

Therefore, creating an audio device that can be worn on a user, in which the user hears sound smoothly without covering the user's ears would be the best solution to the safety problems caused by earphones.

SUMMARY OF THE INVENTION

The main objective of the present invention is to provide a mountable multi-directional audio device, which can be worn on the head, neck or shoulders of a user, so as to avoid the disadvantages of speakers and earphones. For example, speakers cannot be carried on, when earphones are used for a long time, they can damage the user's ears, and users may be distracted when they use earphones.

To achieve the objective, the mountable multi-directional audio device of the present invention comprises at least one broadcasting device 11 and one connecting member 12. Each end of the connecting member 12 is connected to the broadcasting device 11. The broadcasting device 11 has a sounding portion 1111, and a removable or an irremovable baffle plate 112 is disposed at the sounding portion 1111. At least one sound exit 113, which allows the sounding portion 1111 to emit sound, is disposed between the edge of the baffle plate 112 and the sounding portion 1111.

Particularly, the broadcasting device 11 has a sounding portion 1111 outwardly or inwardly.

Particularly, the broadcasting device 11 has at least one speaker 111 inside.

Particularly, a removable or an irremovable baffle plate 112 is disposed at the sounding portion 1111 of the broadcasting device 11, and at least one sound exit 113, which allows the sounding portion 1111 to emit sound, is disposed between the edge of the baffle plate 112 and the sounding portion 1111.

Particularly, a case can be disposed on the surface of the broadcasting device 11. In addition, another case can be disposed on the surface of the connecting member 12.

Particularly, the connecting member 12 has a folding structure 121 to make the broadcasting device 11, extended from the connecting member 12, be folded, and a folding angle of the broadcasting device 11 can be adjusted.

Particularly, an adjusting mechanism is disposed between the connecting member 12 and the broadcasting device 11 in order to allow the broadcasting device 11 be turned toward different directions and positioned.

Particularly, a stretching mechanism 14 is disposed between the connecting member 12 and the broadcasting device 11 in order to allow the length between the connecting member 12 and the broadcasting device 11 be variable.

Particularly, the mountable multi-directional audio device further comprises a sound box, an amplifier and a power management device inside.

Particularly, the mountable multi-directional audio device further accommodates a battery internally.

Particularly, the mountable multi-directional audio device further accommodates a wired or wireless sound signal receiving device internally.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objectives, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objectives.

Figure 1A:
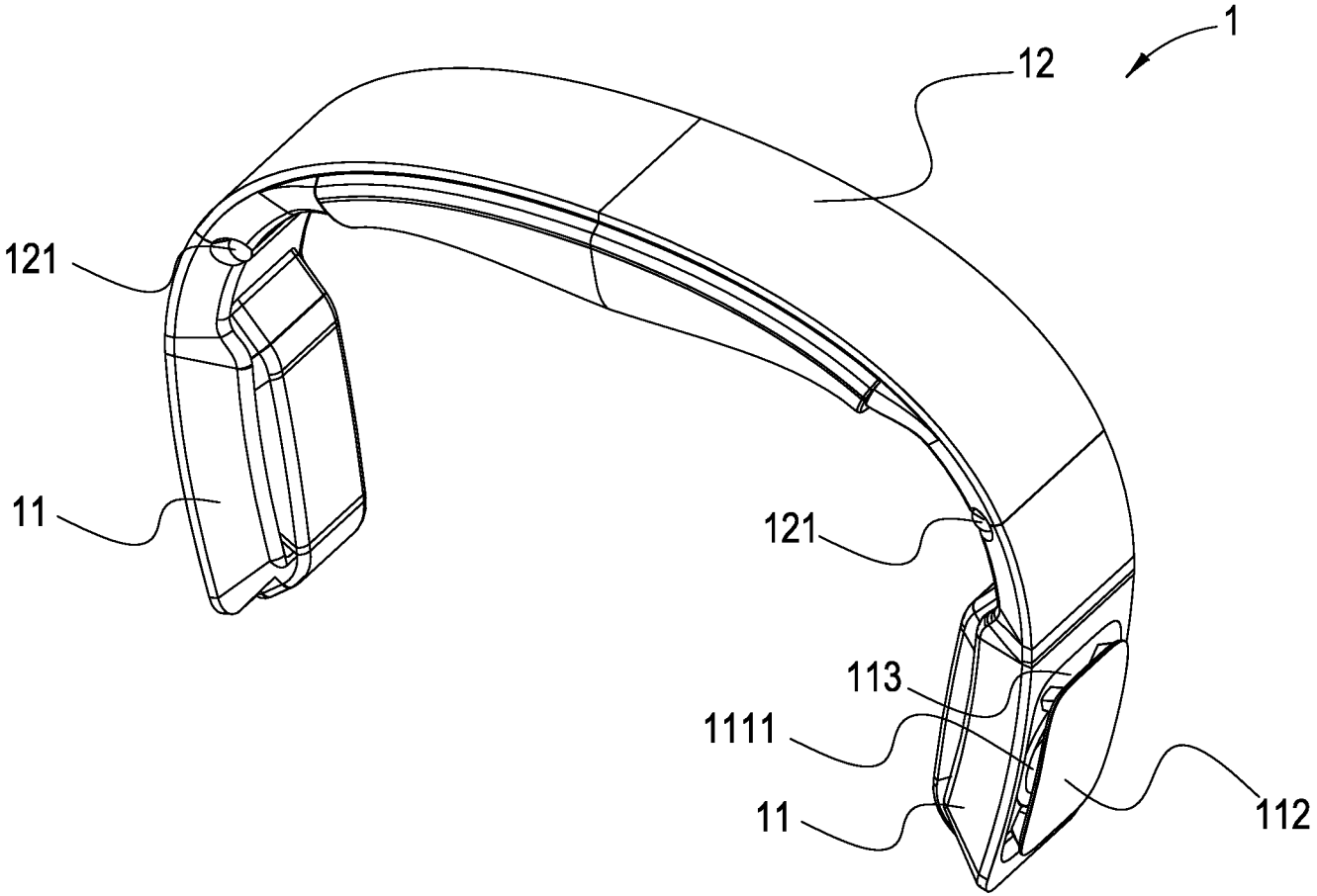
FIG. 1A illustrates a schematic 3-D structural view of a first preferred embodiment of the mountable multi-directional audio device of the present invention.
Figure 1B:
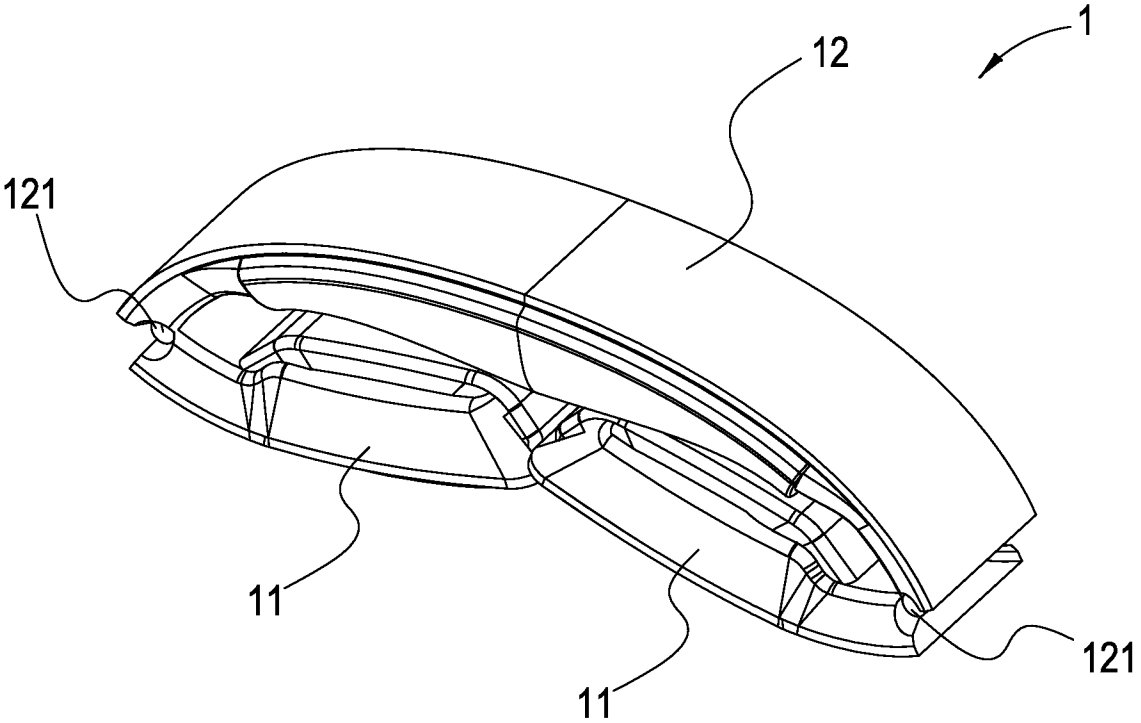
FIG. 1B illustrates a schematic folding view of the first preferred embodiment of the mountable multi-directional audio device of the present invention.
Figure 2A:
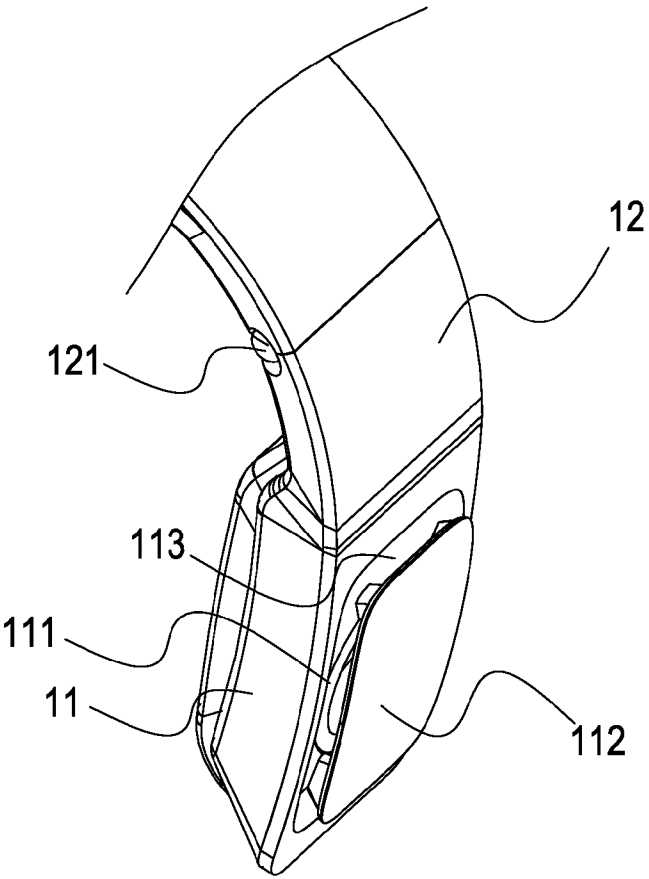
FIG. 2A illustrates a schematic assemble view of a broadcasting device of the mountable multi-directional audio device of the present invention.
Figure 2B:
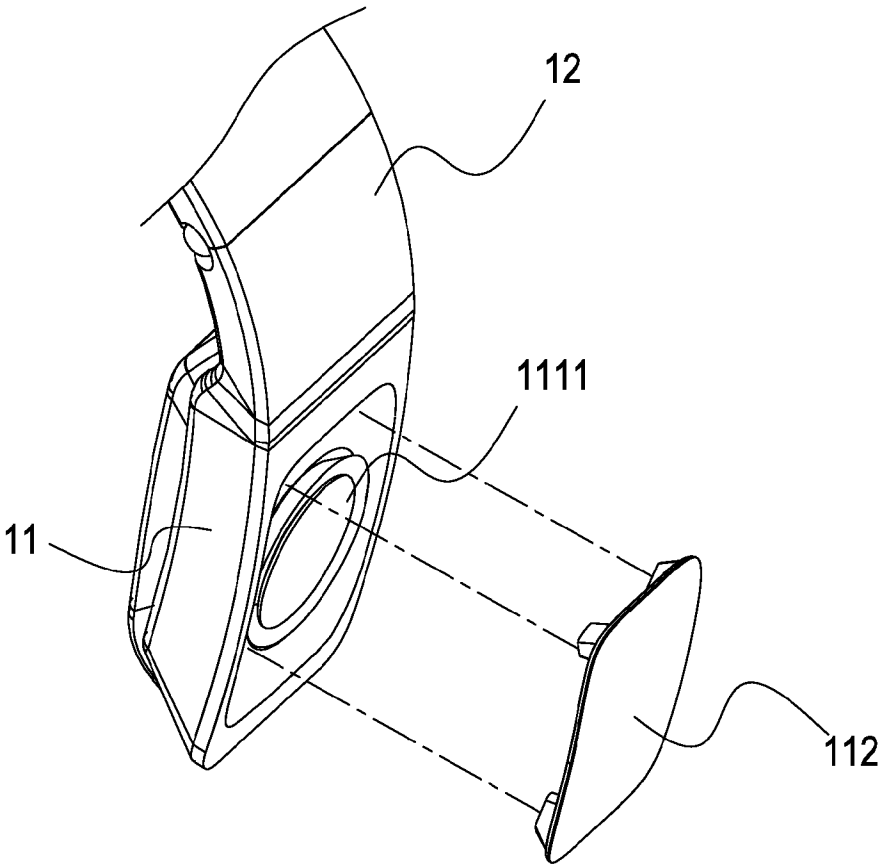
FIG. 2B illustrates a schematic dismantling view of the broadcasting device of the mountable multi-directional audio device of the present invention.
Figure 3A:
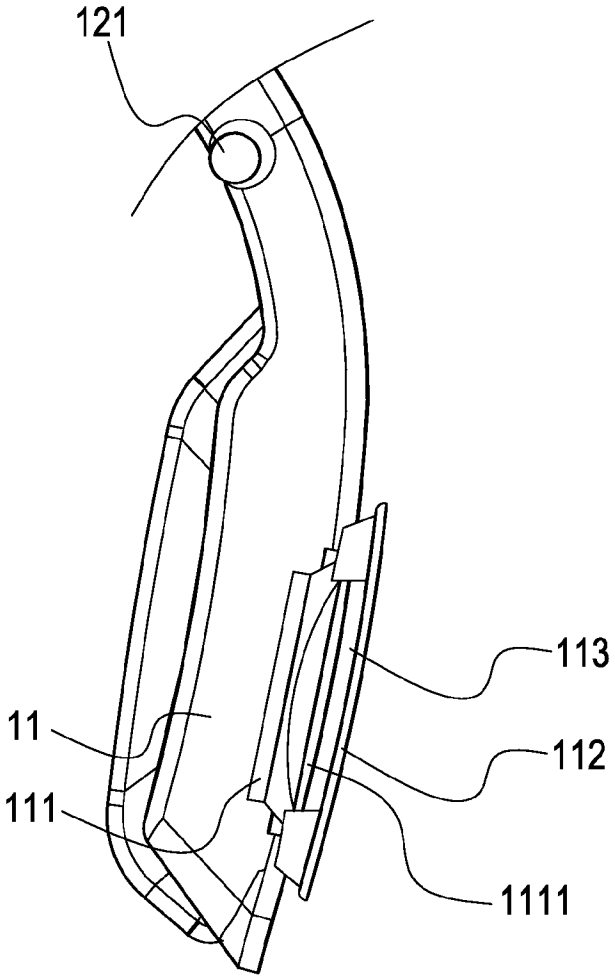
FIG. 3A illustrates a schematic sectional view of the broadcasting device of the first preferred embodiment of the mountable multi-directional audio device of the present invention.
Figure 3B:
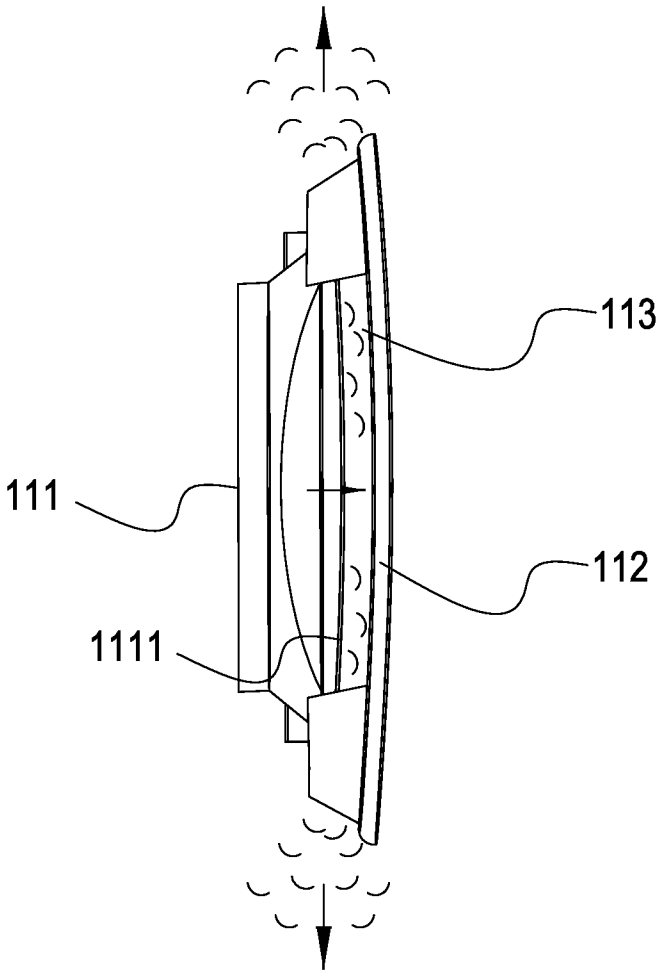
FIG. 3B illustrates a schematic sounding view of the broadcasting device of the first preferred embodiment of the mountable multi-directional audio device of the present invention.

With references to FIG. 1A and FIG. 1B, FIG. 1A and FIG. 1B illustrate a schematic 3-D structural view of a first preferred embodiment of the mountable multi-directional audio device of the present invention and a schematic folding view of the first preferred embodiment of the mountable multi-directional audio device of the present invention respectively. As shown in figures, the mountable multi-directional audio device 1 has two broadcasting devices 11 and one connecting member 12, wherein the two ends of the connecting member 12 are extendable to connect with the broadcasting devices 11. The broadcasting device 11 has at least one speaker 111 inside. As shown in FIG. 3A, the broadcasting device 11 has a sounding portion 1111 outwardly. In addition, a baffle plate 112 is disposed on the sounding portion 1111, in which the baffle plate 112 can be dismantled or un-dismantled. As shown in FIG. 2A and FIG. 2B, at least one sound exit 113 is disposed between the edge of the baffle plate 112 and the sounding portion 1111, so the sound from the sounding portion 1111 will be emitted through the sound exit 113 while the sounding portion 1111 of the speaker 111 is making sounds, as shown in FIG. 3B.

Additionally, the connecting member 12 has a folding structure 121 in order to allow the broadcasting device 11, extended from the connecting member 12, be folded and a folding angle of the broadcasting device 11 be adjusted for each side of the mountable multi-directional audio device 1, so that the mountable multi-directional audio device 1 is able to be placed on a plain surface.

Furthermore, a case can be disposed on the surface of the broadcasting device 11, not shown in figure, and another case can be deposed on the surface of the connecting member 12, not shown in figure. Each side of the mountable multi-directional audio device 1 further comprises a sound box, an amplifier and a power management device inside, not shown in figure, and a battery or wireless device can be optionally adapted, wherein the amplifier is connected with the broadcasting device 11, so that the mountable multi-directional audio device 1 is integrated.

Figure 4:
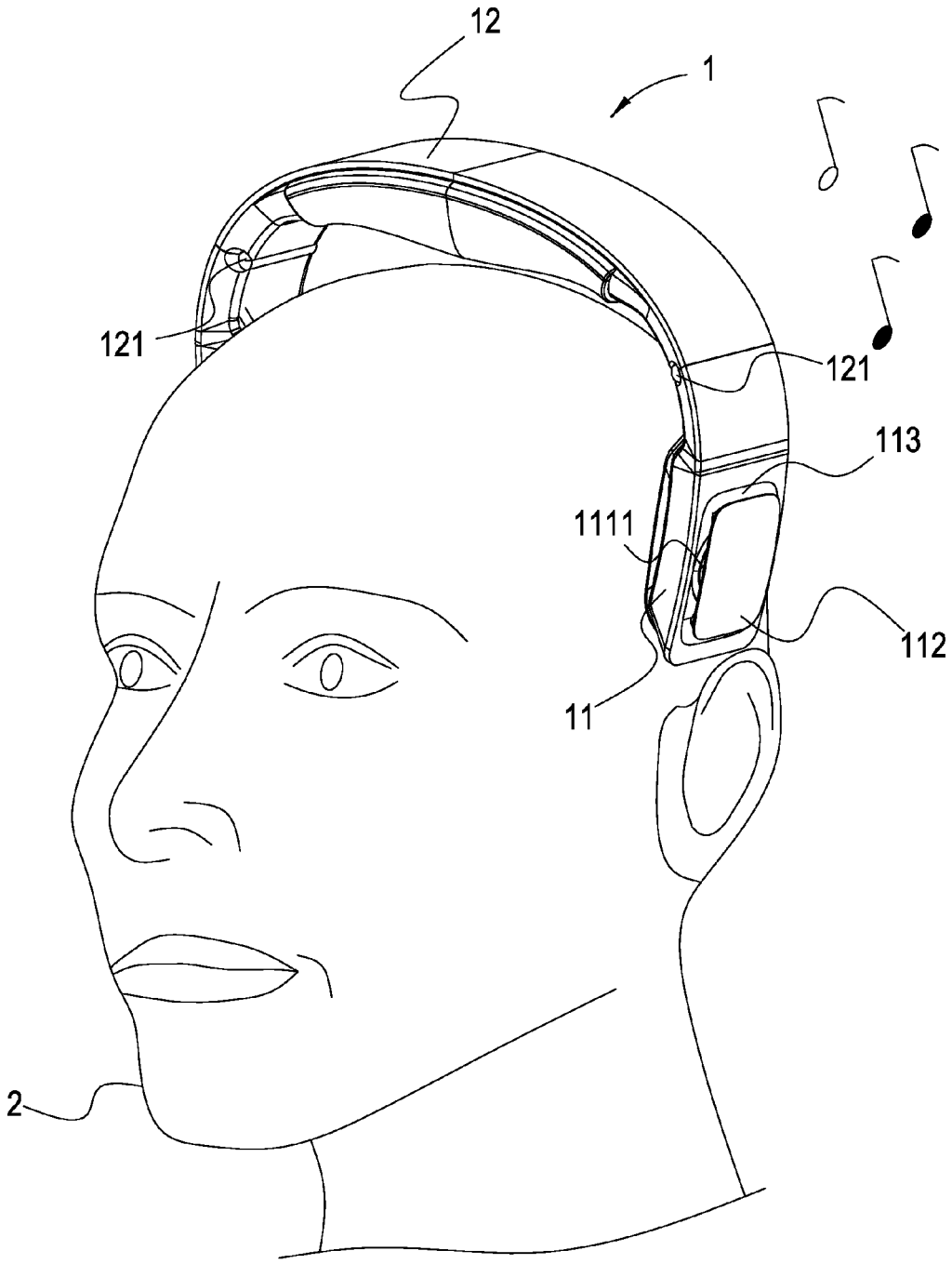
FIG. 4 illustrates a schematic application view of the first preferred embodiment of the mountable multi-directional audio device of the present invention.
Figure 5:
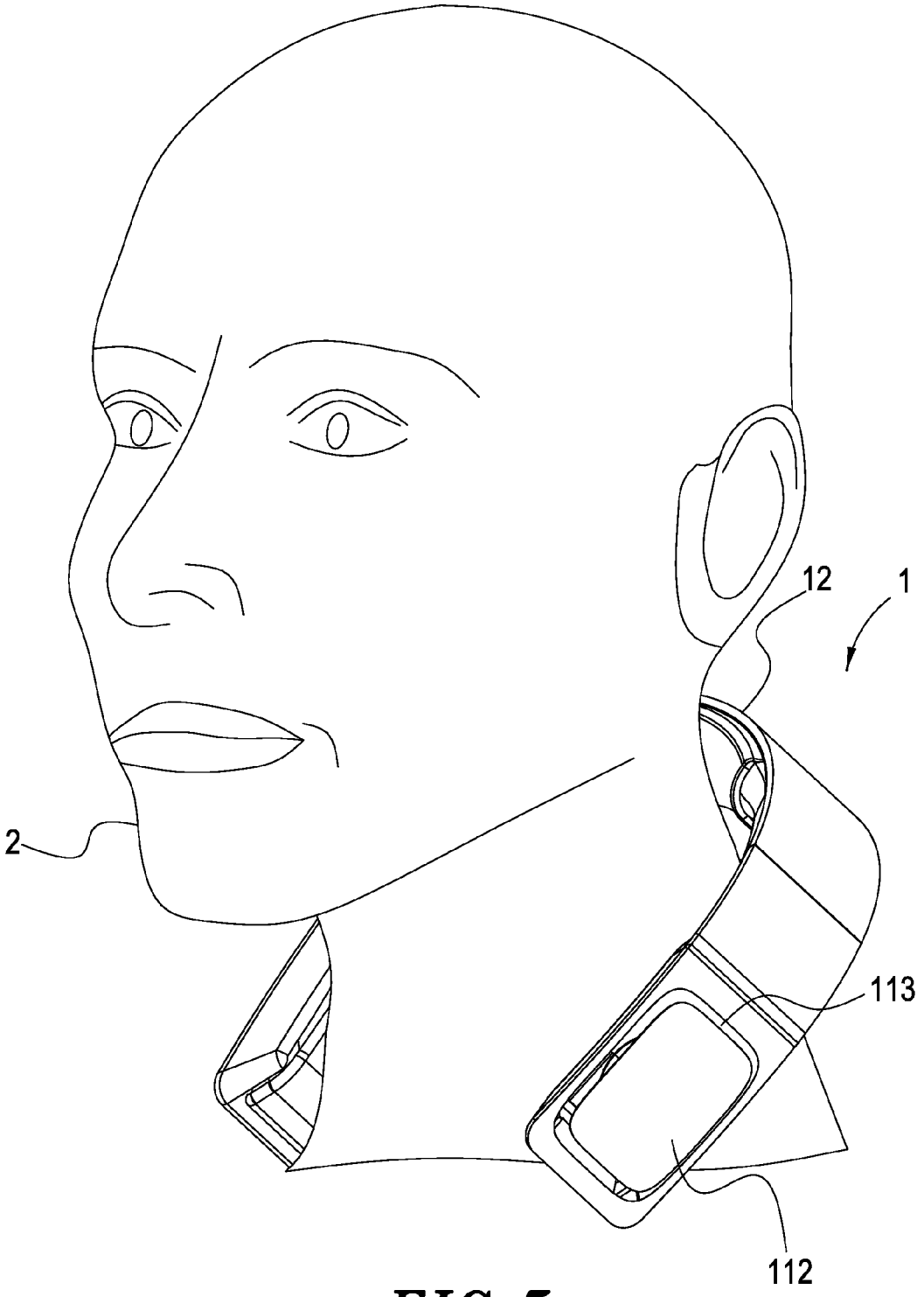
FIG. 5 illustrates a schematic application view of the first preferred embodiment of the mountable multi-directional audio device of the present invention.

As shown in FIG. 4, when a user 2 puts on the mountable multi-directional audio device 1 above the user's ears, sound from the sounding portion 1111 is blocked by the dismantled baffle plate or un-dismantled baffle plate 112, and consequently the sound is emitted through the sound exits 113. Hence, there is no necessary to position the sound portions 1111 toward the ears of the user 2, and the sound from the sounding portions 1111 of the speakers 111 is still heard. The mountable multi-directional audio device 1 of the present invention can be worn on not only a user's head, but also a user's neck or shoulders. As shown in FIG. 5, the mountable multi-directional audio device 1 is worn on the neck of the user 2.

Figure 6A:
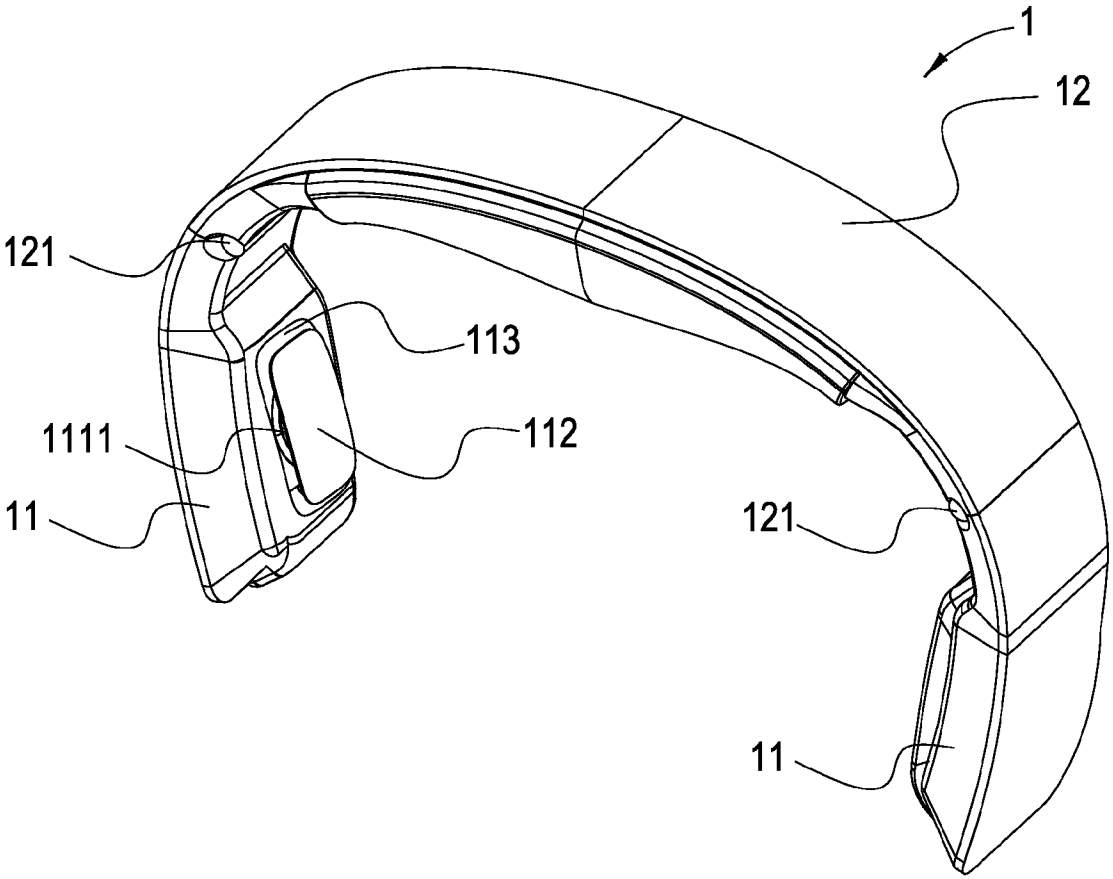
FIG. 6A illustrates a schematic 3-D structural view of a second preferred embodiment of the mountable multi-directional audio device of the present invention.
Figure 6B:
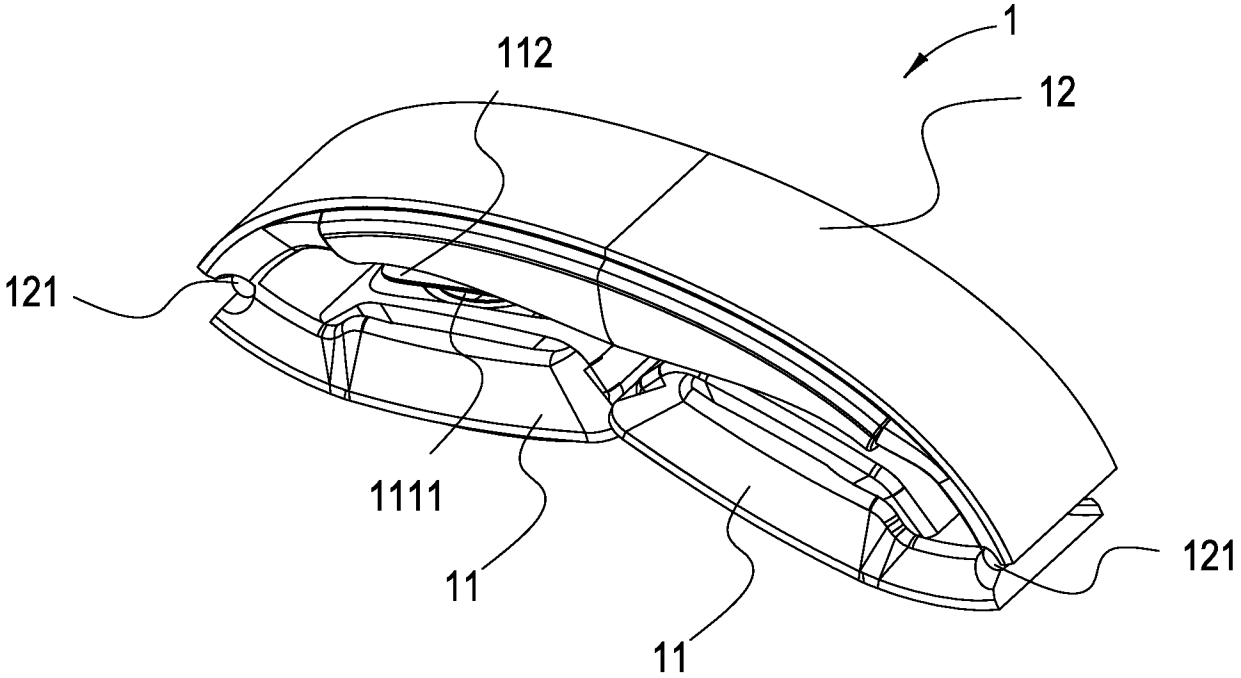
FIG. 6B illustrates a schematic folding view of the second preferred embodiment of the mountable multi-directional audio device of the present invention.
Figure 7:
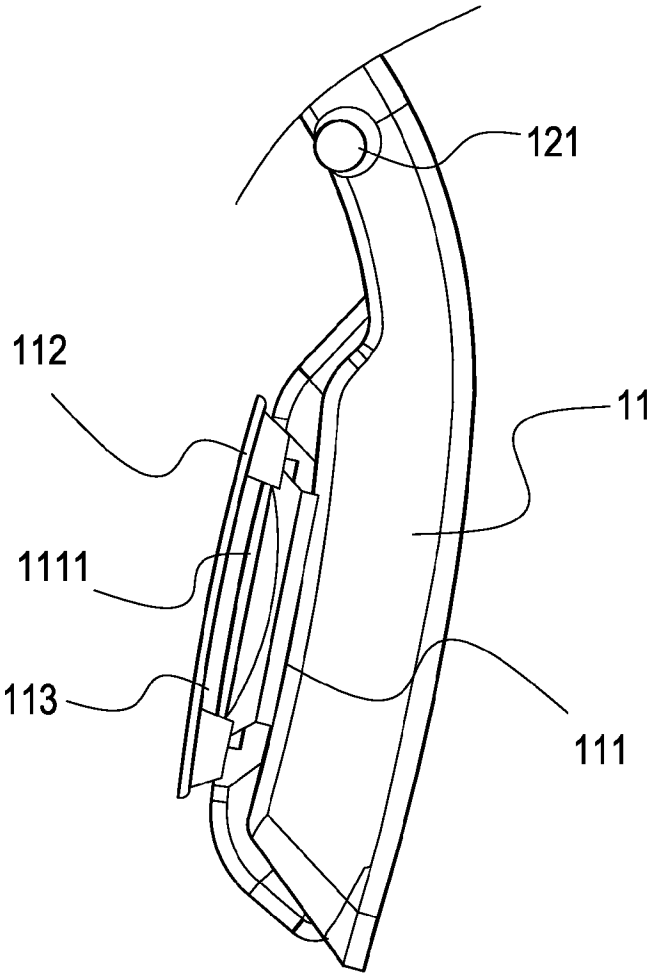
FIG. 7 illustrates a schematic sectional view of the broadcasting device of the second preferred embodiment of the mountable multi-directional audio device of the present invention.
Figure 8:
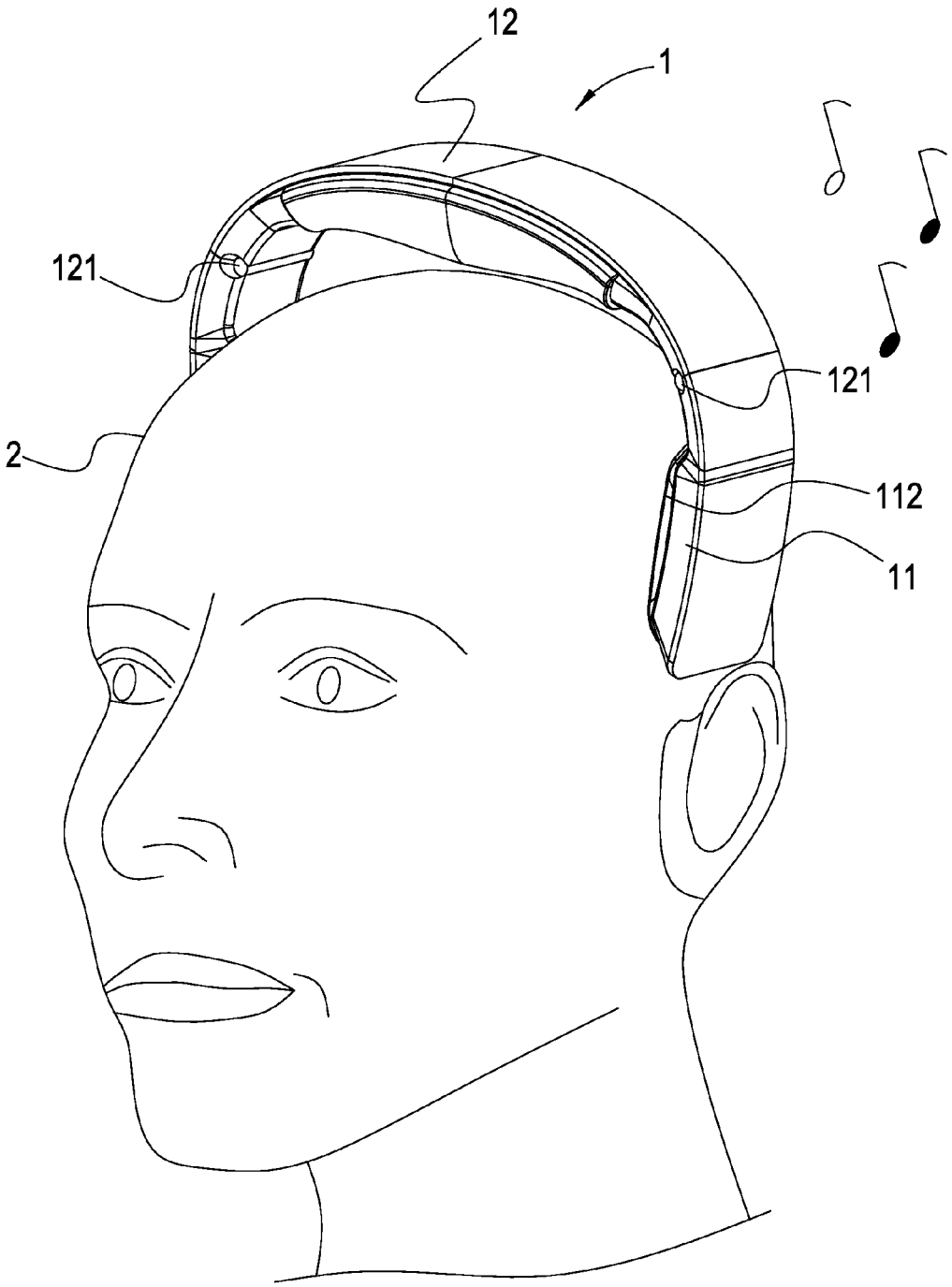
FIG. 8 illustrates a schematic application view of the second preferred embodiment of the mountable multi-directional audio device of the present invention.

In addition to disposing the sounding portion 1111 on the broadcasting device 11 outside, the broadcasting device may have the sounding portion 1111 inwardly as well. As shown in FIG. 6A and FIG. 6B, FIG. 6A and FIG. 6B illustrate a schematic 3-D structural view of a second preferred embodiment of the mountable multi-directional audio device of the present invention and a schematic folding view of the second preferred embodiment of the mountable multi-directional audio device of the present invention respectively. The mechanism of the second preferred embodiment is the same as the mechanism of the first preferred embodiment. The only difference is that the sounding portion 1111 of the speaker 111 in the second preferred embodiment is disposed at the inner surface of the broadcasting device 11, as shown in FIG. 7. Hence, the sound from the sound portions 1111 is spread to the inner side of the broadcasting device 11 and goes out through the sound exits 113. Therefore, there is no necessary to position the sounding portions 1111 toward the user's ears, and the sound from the sounding portions 1111 of the speaker 111 is still heard, as shown in FIG. 8.

Figure 9A:
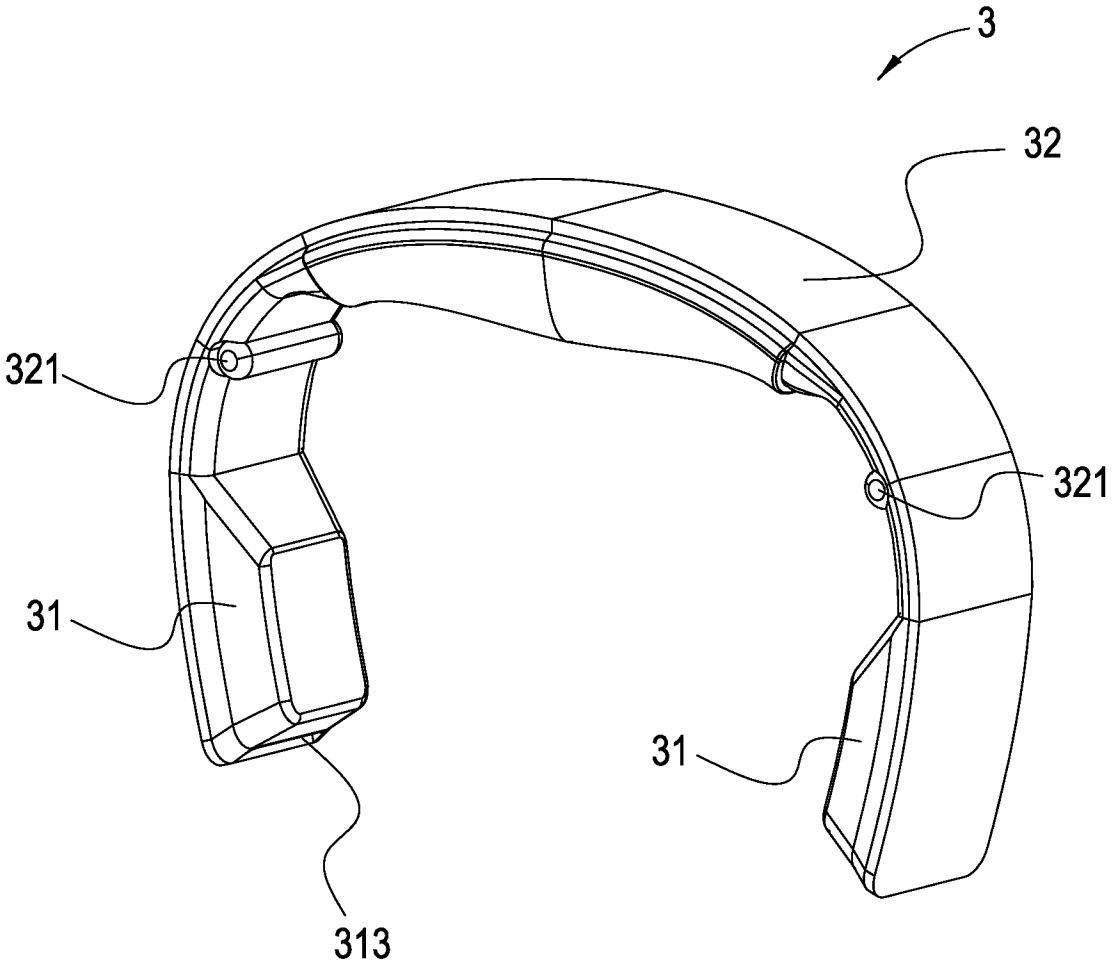
FIG. 9A illustrates a schematic 3-D structural view of a third preferred embodiment of the mountable multi-directional audio device of the present invention.
Figure 9B:
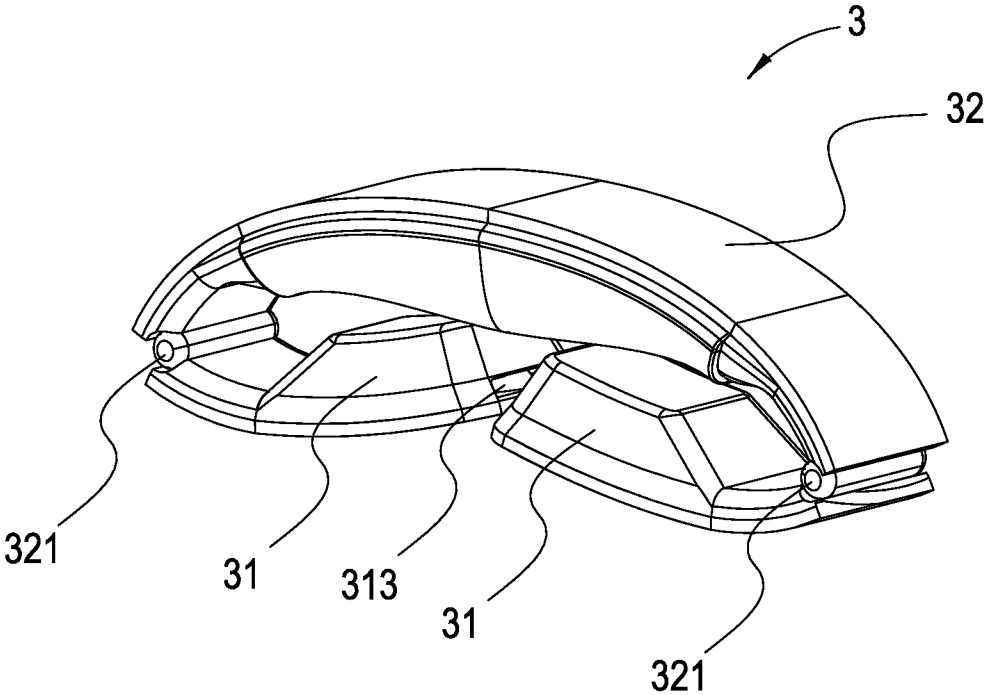
FIG. 9B illustrates a schematic folding view of the third preferred embodiment of the mountable multi-directional audio device of the present invention.
Figure 10A:
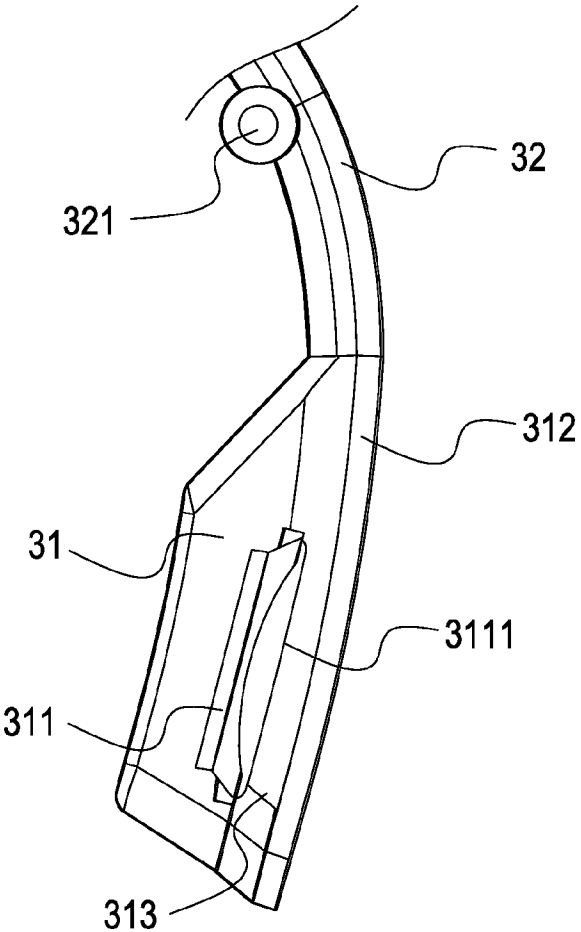
FIG. 10A illustrates a schematic sectional view of the broadcasting device of the third preferred embodiment of the mountable multi-directional audio device of the present invention.
Figure 10B:
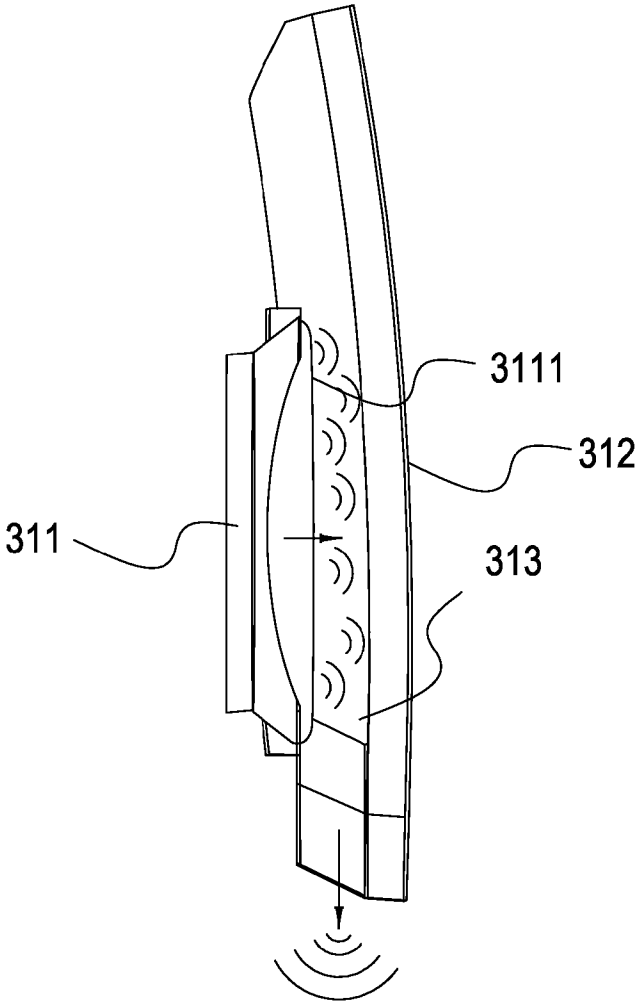
FIG. 10B illustrates a schematic sounding view of the broadcasting device of the third preferred embodiment of the mountable multi-directional audio device of the present invention.

Other than the first preferred embodiment and the second preferred embodiment, the mountable multi-directional audio device 3 could have only a downward sound exit 313 between the side of the dismantled or un-dismantled baffle plate 312 and the sounding portion 3111. As shown in FIG. 9A and FIG. 9B, which point out a third preferred embodiment. The mountable multi-directional audio device 3 has two broadcasting devices 31 and one connecting member 32. The two ends of the connecting member 32 are connected with the broadcasting device 31, and the broadcasting device 31 has at least one speaker 311 inside. As shown in FIG. 10A, the broadcasting device 31 has a sounding portion 3111 outwardly, and a dismantled baffle plate or un-dismantled baffle plate 312 is disposed on the sounding portion 3111 of the broadcasting device 31. As shown in FIG. 10A and FIG. 10B, the downward sound exit 313 is disposed between the side of the baffle plate 312 and the sounding portion 3111, and the sound from the sounding portion 3111 may be reflected by the baffle plate 312 and emitted toward the sound exit 313 while the sounding portion 3111 is making sounds, as shown in FIG. 10B.

Figure 11:
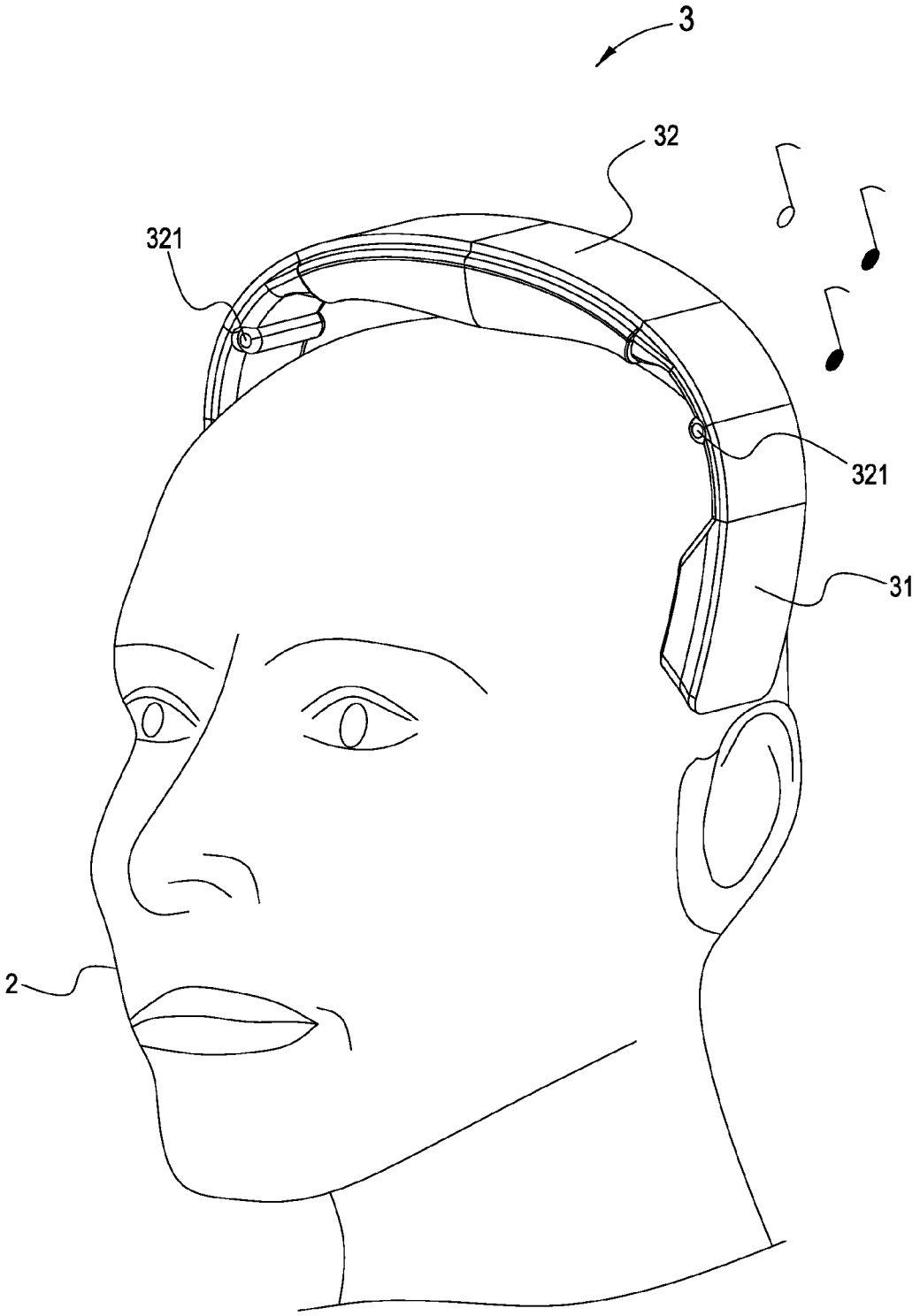
FIG. 11 illustrates a schematic application view of the third preferred embodiment of the mountable multi-directional audio device of the present invention.

As shown in FIG. 11, when a user 2 puts on the mountable multi-directional audio device 3 above the user's ears, sound from the sounding portion 3111 may be reflected by the baffle plate 312, and consequently the sound may be emitted through the sound exits 313. Hence, there is no necessary to position the sound portions 3111 toward the ears of the user 2, and the sound from the sounding portions 3111 of the speakers 311 is still heard.

Moreover, a case can be disposed on the surface of the broadcasting device 31, not shown in figure, and another case can be disposed on the surface of the connecting member 32, not shown in figure. Each side of the mountable multi-directional audio device 3 further comprises a sound box, an amplifier and a power management device inside, not shown in figure, wherein the amplifier is connected with the broadcasting device 11, so that the mountable multi-directional audio device 1 is integrated. A battery or a wired or wireless sound signal receiving device can be optionally adapted by the mountable multi-directional audio device 3, not shown in figure.

Figure 12:
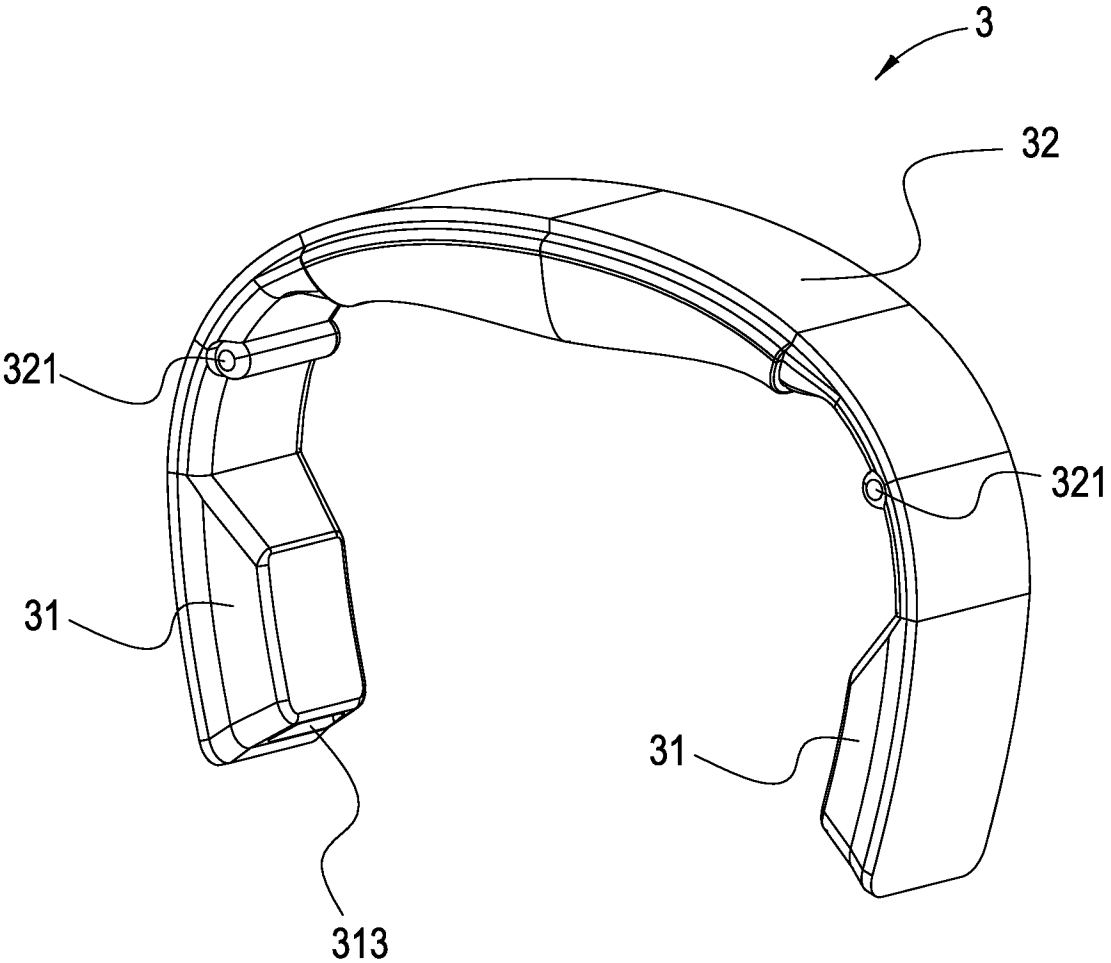
FIG. 12 illustrates a schematic 3-D structural view of a fourth preferred embodiment of the mountable multi-directional audio device of the present invention.
Figure 13:
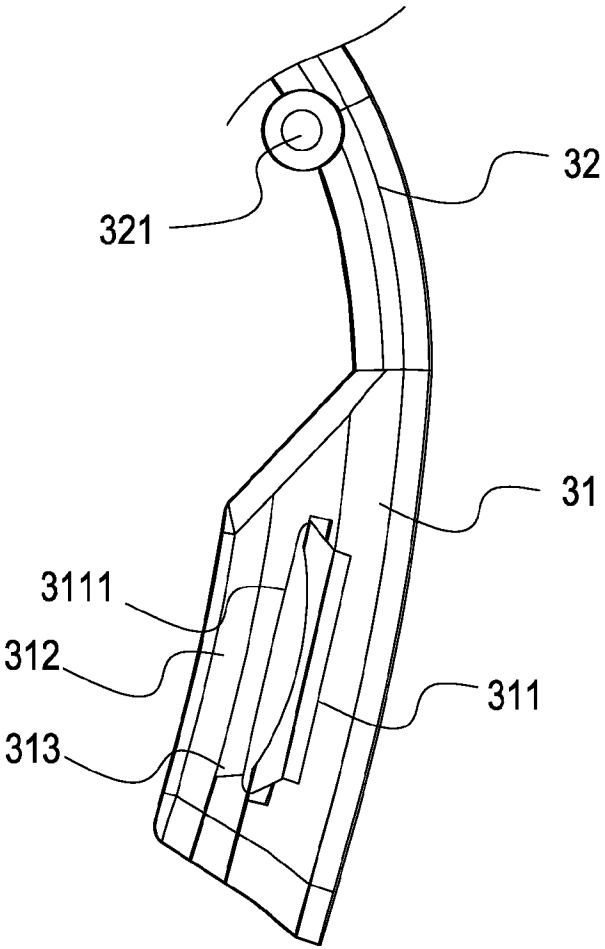
FIG. 13 illustrates a schematic sectional view of the broadcasting device of the fourth preferred embodiment of the mountable multi-directional audio device of the present invention.
Figure 14:
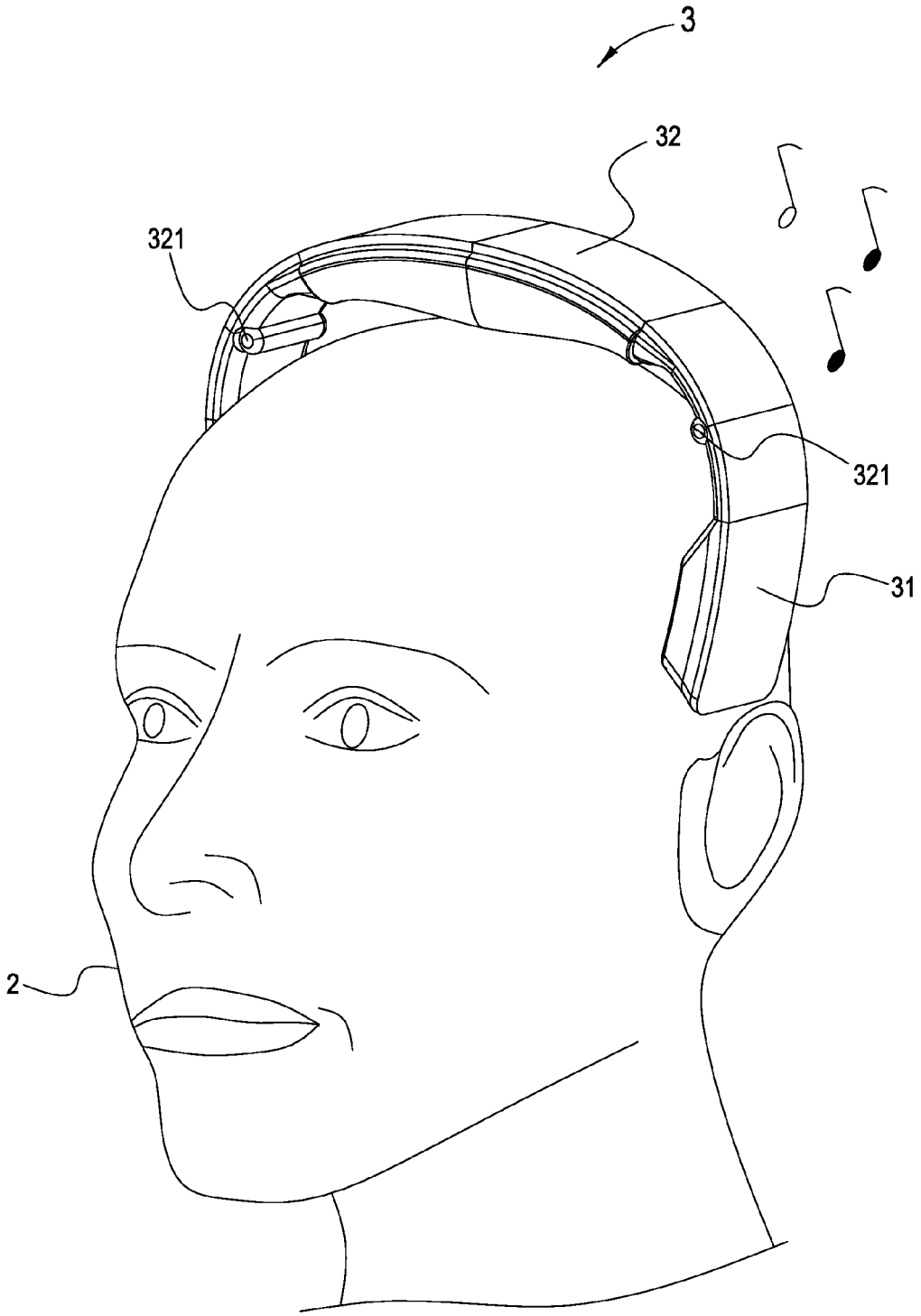
FIG. 14 illustrates a schematic application view of the fourth preferred embodiment of the mountable multi-directional audio device of the present invention.

In addition to disposing the sounding portion 3111 on the broadcasting device 31 outwardly, the broadcasting device 31 may have one sounding portion 3111 inwardly as well, as shown in FIG. 12 and FIG. 13, which illustrate a schematic structural view of a fourth preferred embodiment of the present invention and a schematic sectional view of the fourth preferred embodiment of the present invention. The mechanism of the fourth preferred embodiment is the same as the mechanism of the third preferred embodiment. The only difference is that the sounding portion 3111 of the speaker 311 in the fourth preferred embodiment is disposed inwardly, and the sound exit 313 between the side of the baffle plate 312 and the sounding portion 3111 is disposed inwardly as well, as shown in FIG. 13. As shown in FIG. 14, when the user 2 puts the mountable multi-directional audio device 3 on the user's head, sound from the sounding portion 3111 is reflected by the baffle plate 312, and consequently the sound is emitted through the sound exits 313. Hence, there is no necessary to position the sound portions 3111 toward the ears of the user 2, the sound from the sounding portions 3111 of the speakers 311 is still heard.

Figure 15:
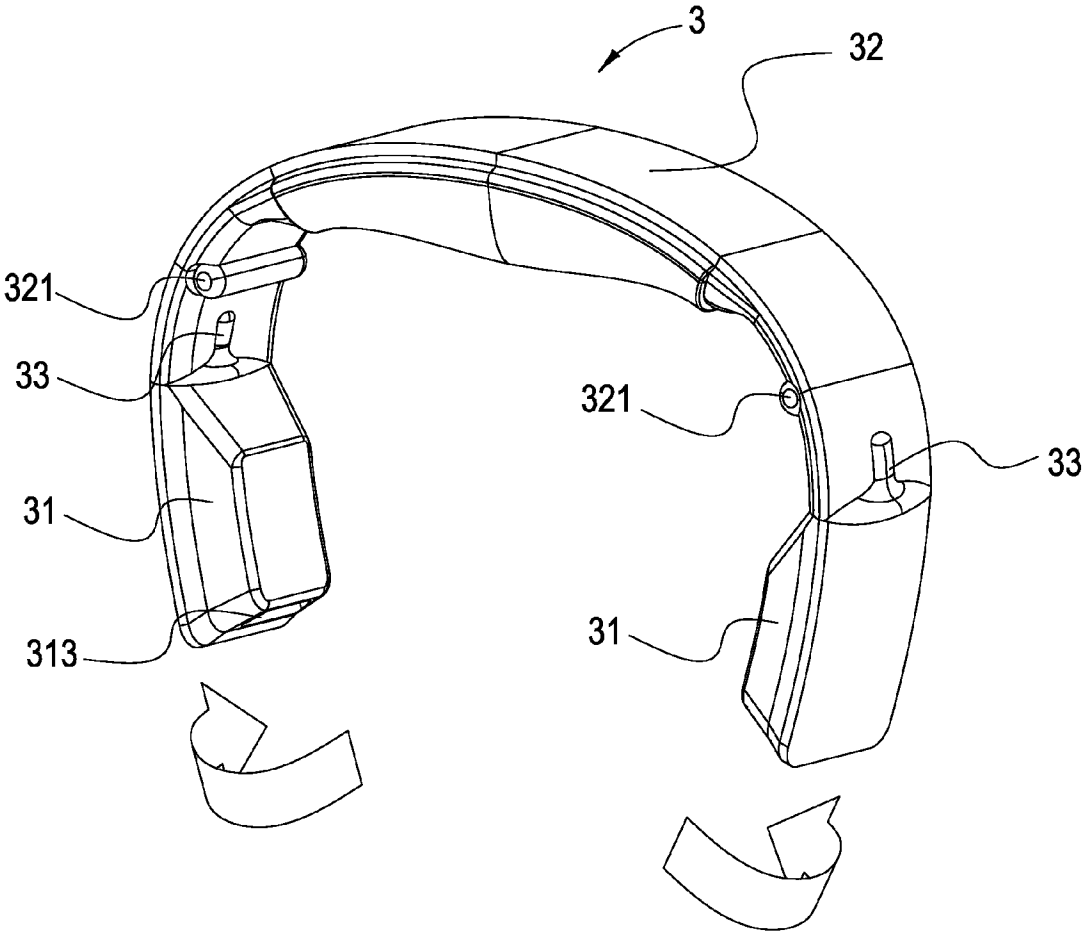
FIG. 15 illustrates a schematic rotation view of a fifth preferred embodiment of the mountable multi-directional audio device of the present invention.
Figure 16:
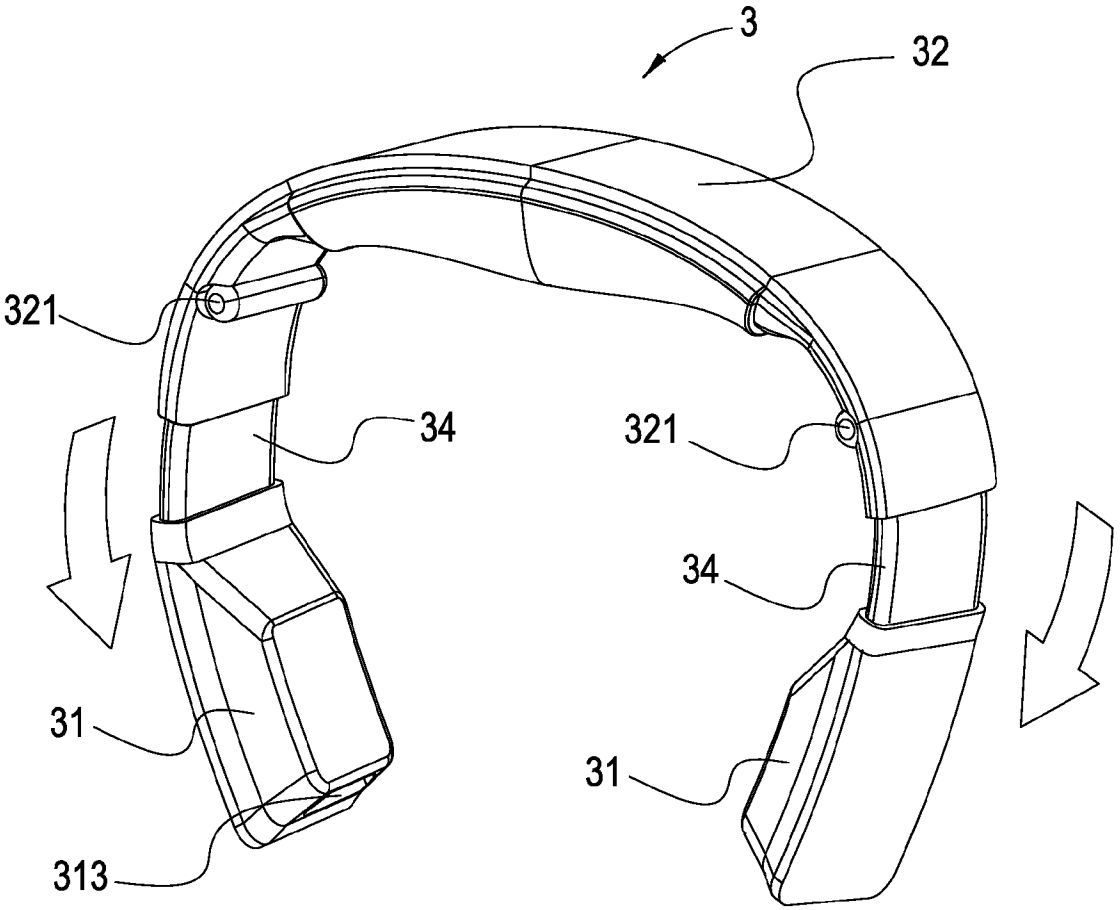
FIG. 16 illustrates a schematic extending view of a sixth preferred embodiment of the mountable multi-directional audio device of the present invention

Moreover, a rotation mechanism 33 is disposed between the connecting member 32 and the broadcasting device 31, and therefore the broadcasting device 31 is capable of rotating toward different directions and positioning, as shown in FIG. 15. A stretching mechanism 34 is disposed between the connecting member 32 and the broadcasting device 11 in order to allow the distance between the connecting member 32 and the broadcasting device 31 be variable, as shown in FIG. 16.

Compared to prior art, the present invention provides the mountable multi-directional audio device has following advantages listed below:

1. The mountable multi-directional audio device of the present invention is a headset audio device and able to let sound be broadcasted toward different directions so as to avoid the situation in that a user may be distracted when using earphones.
2. The mountable multi-directional audio device of the present invention is a headset audio device and able to let sound be broadcasted toward different directions so as to make a low possibility of damaging the ears of a user.
3. Each side of the mountable multi-directional audio device further comprises a sound box, an amplifier and a power management device inside, and in addition to that, a battery or a wired or wireless sound signal receiving device can be optionally adapted by the mountable multi-directional audio device, so the mountable multi-directional audio device is a multi-function and integrated audio device.
4. The mountable multi-directional audio device of the present invention can be folded and carry-on.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the is appended claims.

What is claimed is:

1. A mountable multi-directional audio device comprising:

two broadcasting devices (11), each of the two broadcasting devices 11 having a speaker (111) inside, a sounding portion (1111) of the speaker (111) disposed in each of the broadcasting devices (11) outwardly, an intact baffle plate (112) having at least two stands on the edges of the baffle plate (112) disposed on the sounding portion (1111), and at least one sound exit (113) formed between the edge of the baffle plate (112) and the sounding portion (1111), and the sound exit (113) allowing the sounding portion (1111) to emit sound;

one connecting member (12) having a first end and a second end, each end of the connecting member (12) being connected to one of the broadcasting devices 11; and an adjusting mechanism (33) is disposed between the connecting member (12) and the broadcasting device (11) in order to allow the broadcasting device (11) be turned toward different directions and positioned.

2. The mountable multi-directional audio device according to claim 1, wherein the baffle plate (112) is dismantled or un-dismantled.

3. The mountable multi-directional audio device according to claim 1, wherein a case is further disposed on the surface of the broadcasting device (11).

4. The mountable multi-directional audio device according to claim 1, wherein the connecting member (12) has a folding structure (121) in order to let the broadcasting device (11), extended from the connecting member (21), be folded and a folding angle of the broadcasting device (11) be adjusted.

5. The mountable multi-directional audio device according to claim 1 further comprising a sound box, an amplifier and a power management device inside.

6. The mountable multi-directional audio device according to claim 1 accommodating a battery internally.

7. The mountable multi-directional audio device according to claim 1 accommodating a wired or wireless sound signal receiving device internally.

8. The mountable multi-directional audio device according to claim 1, wherein a case is disposed on the surface of the connecting member (12).

9. The mountable multi-directional audio device according to claim 1, wherein a stretching mechanism (14) is disposed between the connecting member (12) and the broadcasting device (11) in order to allow the length between the connecting member (12) and the broadcasting device (11) be variable.

10. A mountable multi-directional audio device comprising:

two broadcasting device (31), each of the two broadcasting devices (31) having a speaker (311) inside, a sounding portion (3111) of the speaker (311) disposed in each of the broadcasting devices (31) inwardly, an intact baffle plate (312) having at least two stands on the edges of the baffle plate (312) disposed on the sounding portion (3111), and at least one sound exit (313) formed between the edge of the baffle plate (312) and the sounding portion (3111), and the sound exit (313) allowing the sounding portion (3111) to emit sound which has a sounding portion 3111 inwardly;

at least one connecting member (32) having a first end and a second end, the any each end of the connecting member (32) is being connected with to one of the broadcasting devices (31); and an adjusting mechanism (33) is disposed between the connecting member (32) and the broadcasting device (31) in order to let allow the broadcasting device (31) be turned toward different directions and positioned.

11. The mountable multi-directional audio device according to claim 10, wherein the baffle plate (312) is dismantled or un-dismantled.

12. The mountable multi-directional audio device according to claim 10, wherein a case is disposed on the surface of the broadcasting device (31).

13. The mountable multi-directional audio device according to claim 10, wherein the connecting member (32) has a folding structure (321) in order to allow the broadcasting device (31), extended from the connecting member (32), be folded and a folding angle of the broadcasting device (31) be adjusted.

14. The mountable multi-directional audio device according to claim 10 further comprising a sound box, an amplifier and a power management device inside.

15. The mountable multi-directional audio device according to claim 10 accommodating a battery internally.

16. The mountable multi-directional audio device according to claim 10 accommodating a wired or wireless sound signal receiving device internally.

17. The mountable multi-directional audio device according to claim 10, wherein a case is disposed on the surface of the connecting member (32).

18. The mountable multi-directional audio device according to claim 10, wherein a stretching mechanism (34) is disposed between the connecting member (32) and the broadcasting device (31) in order to allow the length between the connecting member (32) and the broadcasting device (31) be variable.

* * * * *